US010509350B2

(12) United States Patent
Sakamaki

(10) Patent No.: US 10,509,350 B2
(45) Date of Patent: Dec. 17, 2019

(54) IMAGE FORMING APPARATUS AND METHOD FOR CONTROLLING THE IMAGE FORMING APPARATUS

(71) Applicant: KONICA MINOLTA, INC., Chiyoda-ku, Tokyo (JP)

(72) Inventor: Tsutomu Sakamaki, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/232,354

(22) Filed: Dec. 26, 2018

(65) Prior Publication Data

US 2019/0227468 A1 Jul. 25, 2019

(30) Foreign Application Priority Data

Jan. 25, 2018 (JP) ..... 2018-010255

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/67
See application file for complete search history.

(56) References Cited

U.S. PATENT DOCUMENTS 9,261,825 B2 * 2/2016 Chiyoda ..... G03G 15/2025
2002/0164172 A1 * 11/2002 Tsubaki ..... G03G 15/2028 399/45
2009/0297233 A1 * 12/2009 Kameda ..... G03G 15/5029 399/322
2013/0058672 A1 * 3/2013 Takada ..... G03G 15/2025 399/67
2014/0308050 A1 * 10/2014 Fukamachi ..... G03G 15/2039 399/69
2015/0016831 A1 * 1/2015 Chiyoda ..... G03G 15/2025 399/43

FOREIGN PATENT DOCUMENTS

JP 2011123333 A 6/2011

* cited by examiner

*Primary Examiner* — Quana Grainger
(74) *Attorney, Agent, or Firm* — Holtz, Holtz & Volek PC

(57) ABSTRACT

An image forming apparatus which can accurately predict occurrence of damage to a fixing rotary member due to passage of a recording material and prevent consequential deterioration of a formed image. The image forming apparatus includes: a pair of fixing rotary members constituting a nip part for nipping a recording material on which a toner image is formed; a surface homogenizing member for homogenizing the surface of the fixing rotary member; a hardware processor that acquires physical property information of the recording material; and a controller for controlling drive of the surface homogenizing member according to the physical property information of the recording material acquired by the hardware processor that acquires the physical property information.

5 Claims, 7 Drawing Sheets

| COUNT VALUE [f] | | RECORDING MATERIAL LENGTH [L] 216 mm OR LESS | | | RECORDING MATERIAL LENGTH [L] MORE THAN 216 mm | | |
|---|---|---|---|---|---|---|---|
| | | ROUGH←SURFACE SMOOTHNESS [R]→SMOOTH | | | ROUGH←SURFACE SMOOTHNESS [R]→SMOOTH | | |
| | | 1 | 2 | 3 | 1 | 2 | 3 |
| BASIS WEIGHT [T] (g/m²) | ~135 | 10 | 5 | 1 | 20 | 10 | 2 |
| | ~300 | 15 | 10 | 5 | 30 | 20 | 10 |
| | MORE THAN 300 | 20 | 15 | 10 | 40 | 30 | 20 |

FIG. 12

| COUNT VALUE [f] | | RECORDING MATERIAL LENGTH [L] 216 mm OR LESS | | | RECORDING MATERIAL LENGTH [L] MORE THAN 216 mm | | |
|---|---|---|---|---|---|---|---|
| | | ROUGH←SURFACE SMOOTHNESS [R]→SMOOTH | | | ROUGH←SURFACE SMOOTHNESS [R]→SMOOTH | | |
| | | 1 | 2 | 3 | 1 | 2 | 3 |
| BASIS WEIGHT [T] (g/m²) | ~135 | 10 | 5 | 1 | 20 | 10 | 2 |
| | ~300 | 15 | 10 | 5 | 30 | 20 | 10 |
| | MORE THAN 300 | 20→25 | 15 | 10 | 40→50 | 30 | 20 |

IMAGE FORMING APPARATUS AND METHOD FOR CONTROLLING THE IMAGE FORMING APPARATUS

CROSS-REFERENCE TO RELATED APPLICATIONS

The entire disclosure of Japanese Patent Application No. 2018-10255, filed on Jan. 25, 2018, is incorporated herein by reference in its entirety.

BACKGROUND

Technological Field

The present invention relates to an electrophotographic image forming apparatus and a method for controlling the image forming apparatus.

Description of the Related Art

An electrophotographic image forming apparatus has a fixing device for fixing toner on a recording material. For example, the fixing device includes a pair of fixing rotary members so that the recording material on which toner has been transferred is passed between the members and the toner is thereby heated and pressed against the recording material. In this fixing device, when a recording material with the same width is passed continuously, scarring or edge damage occurs at a position where a side edge of the recording material passes in the fixing device and if a wider recording material is passed there afterward, a formed image may deteriorate.

As a solution to this problem, a technique is known in which if a cumulative sum of values obtained by multiplying the length of the recording material passed through the fixing device by a weighting factor corresponding to at least one of the width and basis weight of the recording material is a threshold or more, the surface shape of the fixing member is adjusted to prevent deterioration of the formed image (see Patent Literature 1 below).

CITATION LIST

Patent Literature

Patent Literature 1: JP-A-2011-123333

SUMMARY

However, a technique which relies only on the length, width, and basis weight of the recording material passed through the fixing device cannot accurately predict and prevent damage to the fixing rotary member as mentioned above and the consequential deterioration of a formed image.

Therefore, the present invention has an object to provide an image forming apparatus which can accurately predict and prevent damage to the fixing rotary member due to passage of a recording material and the consequential deterioration of a formed image, and a method for controlling the image forming apparatus.

To achieve the abovementioned object, according to an aspect of the present invention, an image forming apparatus reflecting one aspect of the present invention comprises: a pair of fixing rotary members constituting a nip part for nipping a recording material on which a toner image is formed; a surface homogenizing member for homogenizing the surface of the fixing rotary member; a hardware processor that acquires physical property information of the recording material; and a controller for controlling drive of the surface homogenizing member according the physical property information of the recording material acquired by the hardware processor that acquires the physical property information. According to another aspect of the present invention, there is provided a method for controlling the image forming apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 12 is a table which explains updating of the count value to be done in the method for controlling the image forming apparatus according to the second embodiment.

DETAILED DESCRIPTION OF EMBODIMENTS

Hereinafter, one or more embodiments of the present invention will be described with reference to the drawings. However, the scope of the invention is not limited to the disclosed embodiments. The constructional elements which are common to the embodiments are designated by the same reference signs and their description is not repeated.

<<First Embodiment>>

—Structure of the Image Forming Apparatus—

Figure 1:
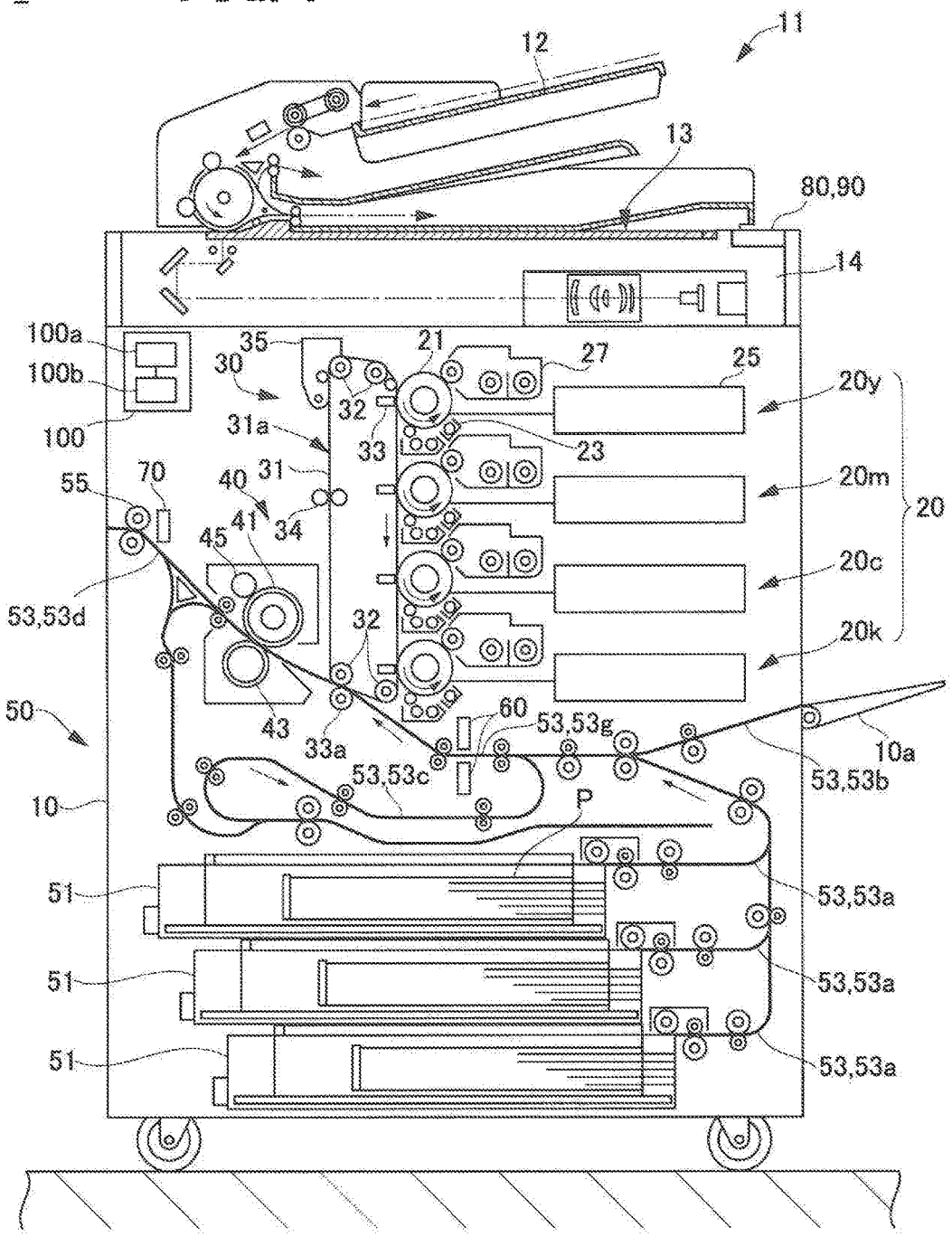
FIG. 1 is a schematic diagram which shows the general structure of an image forming apparatus according to a first embodiment.

FIG. 1 is a schematic diagram which shows the general structure of an image forming apparatus 1 according to the first embodiment and is a view of the electrophotographic image forming apparatus 1 as seen from the front. The image forming apparatus 1 shown in the figure is intended to form an image on a sheet of recording material P such as paper and includes an image reader 11 above a housing 10. Inside the housing 10, an image forming section 20, a transfer section 30, a fixing device 40, a recording material supply section 50, a media sensor 60, and a line sensor 70 are provided. Furthermore, the image forming apparatus 1 includes an operation section 80 and a display section 90. The image forming apparatus 1 further includes a controller 100 connected to these constructional elements. These elements are structured as follows.

<Image Reader 11>

The image reader 11 includes an original feeder 12, an original holder 13 and an imaging section 14. In the image reader 11, the imaging section 14 reads the image of an original sent from the original feeder 12 to the original holder 13 or an original directly placed on the original holder 13 and generates image data. In this embodiment, image data is not limited to data read by the imaging section 14 but instead it may be data received from an external device such as a personal computer connected to the image forming apparatus 1 or another image forming apparatus.

<Image Forming Section 20>

For example, the image forming section 20 includes four image forming units 20*y*, 20*m*, 20*c*, and 20*k* to form toner images of yellow (Y), magenta (M), cyan (C), and black (K). The image forming units 20*y*, 20*m*, 20*c*, and 20*k* each include a photoreceptor 21, electrifying member 23 located around the photoreceptor 21, exposure section 25 and development section 27.

The photoreceptor 21 is an image bearer on which a toner image is formed and is in the form of a drum rotated by a drive motor, in which the side circumferential surface of the drum serves as an image bearing surface. Around the photoreceptor 21, the electrifying member 23, exposure section 25, and development section 27 are located in order from upstream in the rotation direction.

The image bearing surface of the photoreceptor 21 is uniformly electrified by the electrifying member 23 and an electrostatic latent image is formed by exposure-scanning the electrified image bearing surface by the exposure section 25. Exposure scanning by the exposure section 25 is performed, for example, according to the image data read by the image reader 11 or image data received from an external device.

The development section 27 makes color toner adhere to the electrostatic latent image formed on the image bearing surface of the photoreceptor 21 by supplying electrified toner to the image bearing surface of the photoreceptor 21 where the electrostatic latent image is formed. Consequently, a yellow toner image is formed on the image bearing surface 21*a* of the photoreceptor 21 of the image forming unit 20*y*; a magenta toner image is formed on the surface of the photoreceptor 21 of the image forming unit 20*m*; a cyan toner image is formed on the surface of the photoreceptor 21 of the image forming unit 20*c*; and a black toner image is formed on the surface of the photoreceptor 21 of the image forming unit 20*k*.

The image forming units 20*y*, 20*m*, 20*c*, and 20*k* thus structured are arranged with the axes of the photoreceptors 21 parallel to each other. In this arrangement, the image bearing surface of each photoreceptor 21 is oriented in the same direction between the development section 27 and electrifying member 23.

<Transfer Section 30>

The transfer section 30 is located in parallel to the image forming section 20. The transfer section 30 includes an intermediate transfer belt 31 as an endless rotating belt and a plurality of rollers 32 and primary transfer parts 33 which are inscribed in the intermediate transfer belt 31. The transfer section 30 includes a secondary transfer roller 33*a*, neutralizing rollers 34, and a cleaning unit 35.

The intermediate transfer belt 31 is wound around the plurality of rollers 32 with its outer circumferential surface serving as an image bearing surface 31*a*. The intermediate transfer belt 31 rotates in the direction opposite to the rotation direction of the photoreceptors 21 of the image forming units 20*y*, 20*m*, 20*c*, and 20*k* and is located so that its image bearing surface 31*a* comes into contact with all the photoreceptors 21 sequentially.

The rollers 32 are located on the inner circumference side of the intermediate transfer belt 31 so that the image bearing surface 31*a* of the intermediate transfer belt 31 comes into contact with all the photoreceptors 21. One of the rollers 32 functions as a drive roller to rotate the intermediate transfer belt 31.

The primary transfer parts 33 are located on the inner circumference side of the intermediate transfer belt 31 in a manner to face the photoreceptors 21 of the image forming units 20*y*, 20*m*, 20*c*, and 20*k* and hold the intermediate transfer belt 31 between the primary transfer parts 33 and the photoreceptors 21, respectively. A voltage with polarity opposite to the polarity of toner is applied to the primary transfer parts 33, thereby transferring the toner adhering to the image bearing surface of each photoreceptor 21 to the image bearing surface 31*a* of the intermediate transfer belt 31.

The secondary transfer roller 33*a* is located on the image bearing surface 31*a* side of the intermediate transfer belt 31 in a manner to face one of the rollers 32 and hold the intermediate transfer belt 31 between the roller 33*a* and the roller 32. The nip part at which the secondary transfer roller 33*a* and the roller 32 come into contact with each other is a transfer position where the toner image formed on the image bearing surface 31*a* of the intermediate transfer belt 31 is transferred to the recording material P conveyed from the recording material supply section 50 which will be described later.

The neutralizing rollers 34 are located downstream of the secondary transfer roller 33*a* in the rotation direction of the intermediate transfer belt 31 and upstream of the primary transfer parts 33 in a manner to hold the intermediate transfer belt 31 between the rollers 34 to remove the electric charge from the intermediate transfer belt 31.

The cleaning unit 35 is located on the outer circumference side of the intermediate transfer belt 31 between the neutralizing rollers 34 and the primary transfer part 33 in a manner to face the image bearing surface 31*a* of the intermediate transfer belt 31. The cleaning unit 35 is intended to remove residual toner on the image bearing surface 31*a* of the intermediate transfer belt 31.

<Fixing Device 40>

Figure 2:
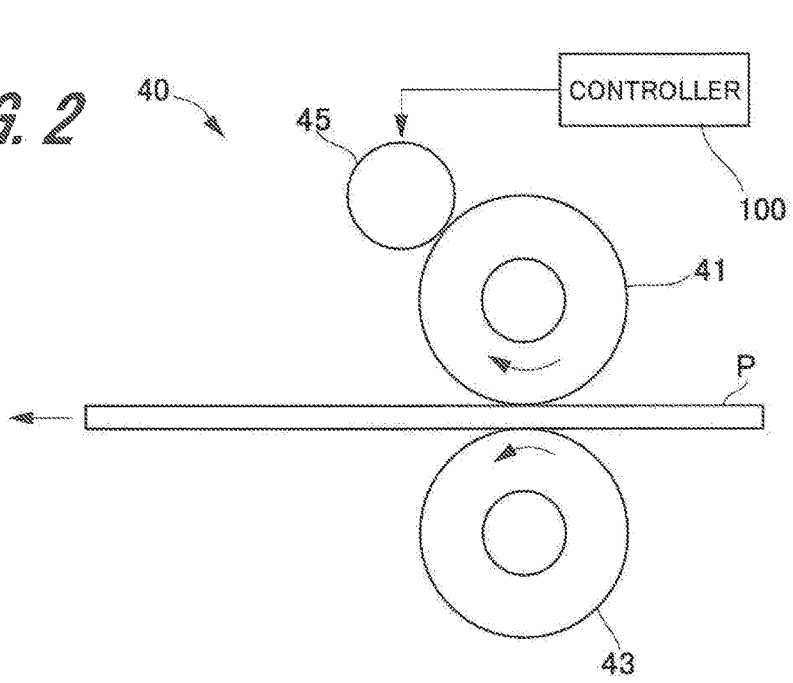
FIG. 2 shows the structure of the fixing device of the image forming apparatus according to the first embodiment.

The fixing device 40 is located downstream of the secondary transfer roller 33*a* in the transfer section 30 in the direction of conveyance of the recording material P conveyed from the recording material supply section 50 which will be described next. FIG. 2 shows the structure of the fixing device 40 of the image forming apparatus according to the first embodiment. As shown in the figure, the fixing device 40 includes a heating roller 41 and a pressure roller 43 as a pair of fixing rotary members, and a surface homogenizing member 45.

The heating roller 41 and pressure roller 43 constitute a nip part which nips the recording material P conveyed from the secondary transfer roller 33*a* by their side circumferential surfaces. The toner image transferred onto the recording material P is fixed on the recording material P by heating the nipped recording material P and the recording material P on which the toner image has been fixed is delivered to outside of the housing 10.

The heating roller 41 and pressure roller 43 constitute a pair of fixing rotary members which incorporate a heating controller. The heating roller 41 and pressure roller 43 have a structure in which the side circumference of a cylindrical core made of metal such as iron is covered by a heat-resistant elastic layer, for example, of silicon rubber and the surface thus covered is further covered by fluorine resin as a mold release layer. The recording material P conveyed to the fixing device 40 is nipped between the side circumferential surfaces of the heating roller 41 and pressure roller 43 thus structured.

The surface homogenizing member 45 is a polishing roller made of a metal material such as stainless steel or aluminum. The surface homogenizing member 45 is located so as to be able to come into contact with or leave the side circumferential surface of at least the roller which comes into contact with the surface of the recording material P on which the toner image is formed, either the heating roller 41 or the pressure roller 43 (the heating roller 41 in this example). By polishing the side circumferential surface of the heating roller 41, the surface homogenizing member 45 removes scarring or edge damage on the side circumferential surface of the heating roller 41 which is caused by an edge of the recording material P due to passage of the recording material P.

The surface homogenizing member 45 may be rotated as it is driven by rotation of the heating roller 41 or may have a drive part and be able to rotate at a different speed from the rotation speed of the heating roller 41. If the surface homogenizing member 45 can rotate at a different speed from the rotation speed of the heating roller 41, the time to polish the side circumferential surface of the heating roller 41 can be shortened.

The surface homogenizing member 45 is connected to the controller 100 which will be described later, so that whether it comes into contact with or leaves the side circumferential surface of the heating roller 41 is controlled by the controller 100 and in some cases, the rotation speed is controlled.

The heating roller 41 may be, for example, a heating roller with a built-in heating controller, in which a fixing belt is wound between the heating roller 41 and another roller, though not shown here. In such a fixing belt, the outer circumferential surface which faces the pressure roller 43 is covered by a heat-resistant elastic layer, for example, of silicon rubber and the surface thus covered is further covered by fluorine resin as a mold release layer. In this case, the recording material P conveyed from the recording material supply section 50 is nipped between the fixing belt and the pressure roller 43. The surface homogenizing member 45 as a polishing roller is located so that the side circumferential surface of the roller can come into contact with or leave the outer circumferential surface of the fixing belt.

<Recording Material Supply Section 50>

Again referring to FIG. 1, the recording material supply section 50 includes a plurality of supply trays 51 and a conveyance passage 53 for conveying the recording material P. The supply trays 51 are provided to supply recording materials P of different sizes and different types. Each supply tray 51 houses the recording material P and supplies the housed recording material P to the conveyance passage 53 sheet by sheet.

The conveyance passage 53 includes an individual conveyance path 53*a* to convey the recording material P supplied from each supply tray 51 to the secondary transfer roller 33*a* sheet by sheet. If the image forming apparatus 1 has a manual feed tray 10*a* outside the housing 10, the conveyance passage 53 includes a manual conveyance path 53*b* to convey the recording material P introduced from the manual feed tray 10*a* to the secondary transfer roller 33*a*. Furthermore, the conveyance passage 53 includes a reverse conveyance path 53*c* to reverse the recording material P passed through the fixing device 40 and convey it to the secondary transfer roller 33*a* again.

The individual conveyance paths 53*a*, manual conveyance path 53*b*, and reverse conveyance path 53*c* converge on the upstream side of the secondary transfer roller 33*a* to make up a confluent conveyance path 53*g* in which the recording material P is supplied to the secondary transfer roller 33*a*. The conveyance passage 53 also includes a delivery path 53*d* to convey the recording material P passed through the fixing device 40 to the delivery roller 55 for delivering the recording material P.

<Media Sensor 60>

The media sensor 60 is a means to acquire the physical property information of the recording material P conveyed by the conveyance passage 53. The media sensor 60 includes a surface sensor for detecting the surface smoothness of the recording material P and a basis weight sensor for detecting the basis weight of the recording material P. The media sensor 60 is located over the conveyance passage 53 for the recording material P and upstream of the secondary transfer roller 33*a* in the conveyance direction of the recording material P in the conveyance passage 53, preferably in the confluent conveyance path 53*g*.

Figure 3:
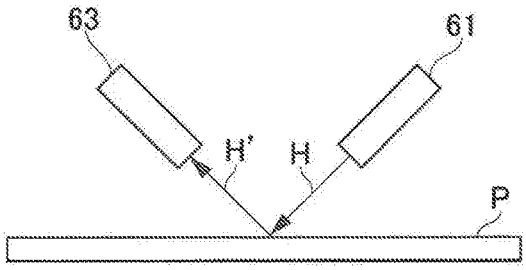
FIG. 3 shows an example of the surface sensor of the media sensor provided in the image forming apparatus according to the first embodiment.

FIG. 3 shows an example of the surface sensor 60*a* of the media sensor 60 provided in the image forming apparatus 1 according to the first embodiment. As shown in the figure, the surface sensor 60*a* includes an irradiating member 61 for irradiating the recording material P with inspection light H and a light receiving member 63 for receiving reflected light H' as inspection light H specularly reflected by the recording material P. Inspection light H is, for example, laser light.

The surface sensor 60*a* can detect the surface smoothness [R] of the recording material P according to the amount of reflected light H' received by the light receiving member 63. Specifically, when the roughness [R] of the recording material P is larger, inspection light H is reflected more diffusely by the surface of the recording material P and thus the amount of reflected light H' received by the light receiving member 63 is smaller.

Figure 4:
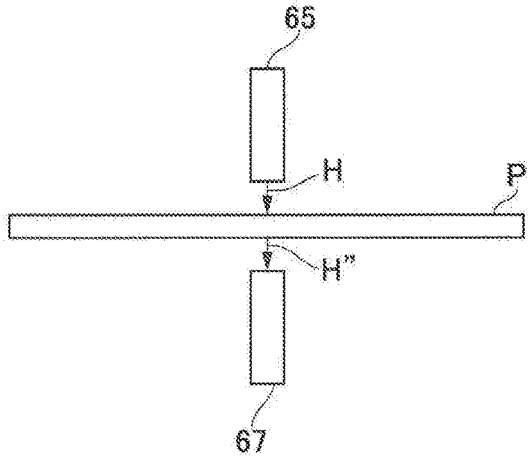
FIG. 4 shows an example of the basis weight sensor of the media sensor provided in the image forming apparatus according to the first embodiment.

FIG. 4 shows the basis weight sensor 60*b* of the media sensor 60 provided in the image forming apparatus 1 according to the first embodiment. As shown in the figure, the basis weight sensor 60*b* may include an irradiating member 65 for irradiating the recording material P with inspection light H and a light receiving member 67 for receiving transmitted light H" as inspection light H transmitted through the recording material P. In this case, when the basis weight [T] of the recording material P is larger, the amount of transmitted light H" transmitted through the recording material P and received by the light receiving member 67 is smaller and thus the basis weight [T] of the recording material P can be detected.

The media sensor 60 may include a thickness sensor for detecting the thickness of the recording material P and further a stiffness sensor for detecting the stiffness of the recording material P in place of the basis weight sensor 60*b* or in addition to the surface sensor 60*a* and basis weight sensor 60*b*. The thickness sensor should measure the thickness of the recording material P, for example, by an optical or a mechanical method. The stiffness sensor should measure the stiffness of the recording material P, for example, by a mechanical method.

<Line Sensor 70>

Again referring to FIG. 1, the line sensor 70, intended to read the image formed on the recording material P, is located, for example, in the delivery path 53*d* between the fixing device 40 and delivery roller 55. The line sensor 70 may be a commonly used inline sensor and includes a CCD or a CMOS sensor. The image forming apparatus 1 may have, for example, a function to correct the image density at the time of image formation or acquire image information to make the image forming conditions adequate, according to the image read by the line sensor 70.

<Operation Section 80>

The operation section 80, intended to enter setup conditions relating to image formation, may be operation keys provided on the upper surface of the housing 10 or a touch panel provided on the display surface of the display section 90 which will be described next. Alternatively, the operation section 80 may be an external device connected to the image forming apparatus 1, such as a personal computer.

<Display Section 90>

The display section 90, intended to display setup conditions relating to image formation, is, for example, a flat-screen display provided on the upper surface of the housing 10. The display section 90 may have a touch panel as the operation section 80, on the display surface. Alternatively, the display section 90 may be an external device connected to the image forming apparatus 1, such as a personal computer.

<Controller 100>

The controller 100, intended to control operation of various elements of the image forming apparatus 1, includes a computing machine such as a microcomputer. The computing machine includes a CPU (Central Processing Unit), a ROM (Read Only Memory), and a RAM (Random Access Memory).

The controller 100 thus structured includes an image formation controller 100*a* for forming an image on the recording material P and a refresh operation controller 100*b* for controlling the drive of the surface homogenizing member 45 of the fixing device 40.

The image formation controller 100*a* controls the drive parts of the image reader 11, image forming section 20, transfer section 30, fixing device 40, and recording material supply section 50 according to settings entered from the operation section 80 and an external device such as a personal computer to control the formation of an image on the recording material P.

On the other hand, the refresh operation controller 100*b* controls the drive of the surface homogenizing member 45 of the fixing device 40 according to settings entered from the operation section 80 and an external device such as a personal computer and the result of detection by the surface sensor 60*a*.

Figures 5, 6:
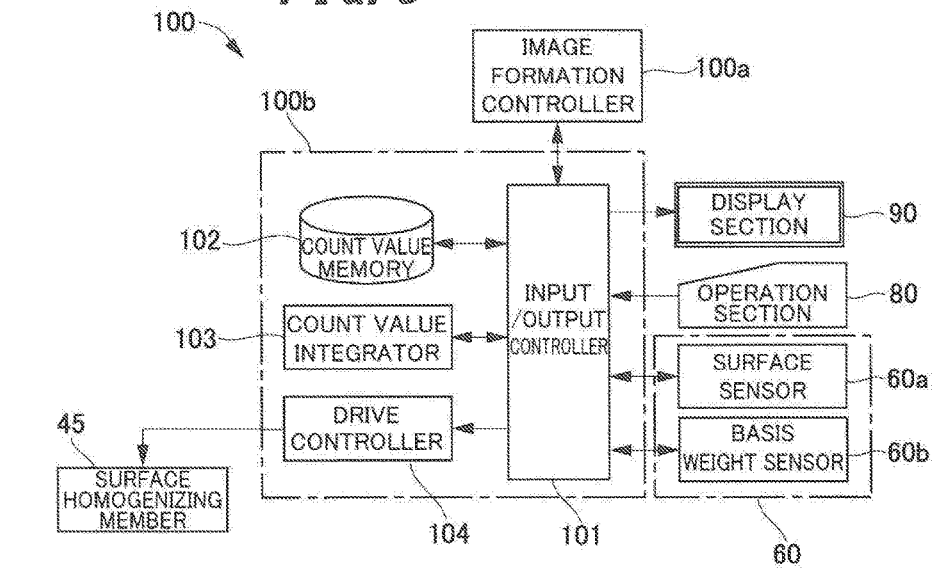
FIG. 5 is a block diagram which shows a key part of the image forming apparatus according to the first embodiment.
FIG. 6 shows an example of count values stored in a memory of the image forming apparatus according to the first embodiment.

FIG. 5 is a block diagram which shows a key part of the image forming apparatus 1 according to the first embodiment, focusing on the configuration of the refresh operation controller 100*b*. The refresh operation controller 100*b* includes an input/output controller 101, a count value memory 102, a count value integrator 103, and a drive controller 104. These elements have the functions described next and when the CPU of the controller 100 reads the program stored in the ROM and executes it, the functions are performed. Next, the elements which constitute the refresh operation controller 100*b* will be described in detail.

[Input/Output Controller 101]

The input/output controller 101 interconnects the constructional elements of the refresh operation controller 100*b*, the image formation controller 100*a*, the surface sensor 60*a*, the basis weight sensor 60*b*, the operation section 80, and the display section 90. The input/output controller 101 performs processing for input and output of data between mutually connected elements and processing for decision to control the drive of the surface homogenizing member 45 of the fixing device 40. How the input/output controller 101 controls the drive of the surface homogenizing member 45 will be described in detail later in connection with the method for controlling the image forming apparatus 1.

[Count Value Memory 102]

The count value memory 102 is a storage which stores the count value [f] as the magnitude of damage to the fixing device 40 caused by the recording material P which is expressed in numerical form. FIG. 6 shows an example of count values [f] stored in the count value memory 102 of the image forming apparatus 1 according to the first embodiment. A count value [f] is a value obtained by weighting of the magnitude of damage to the fixing device 40 for each of the length [L], surface smoothness [R], and basis weight [T] of the recording material P and should be a value obtained from data collected in advance.

As shown in FIG. 6, such count values [f] are stored in the count value memory 102 as values linked to the length [L], surface smoothness [R], and basis weight [T] of the recording material P. In this case, the count value [f] need not be linked to the width of the recording material P, namely the size in the width direction perpendicular to the conveyance direction. However, the count value [f] may be stored in the count value memory 102 as data linked to the size of the recording material P in the width direction and if that is the case, prediction can be made more accurately.

The length [L] of the recording material P is a length in the direction of conveyance of the recording material P and size information of the recording material P. For example, a count value [f] is allocated to each class of length [L], in which different lengths of the recording material P are classified. One example given here assumes two types of recording material P, one type having a length [L] of 216 mm or less and the other type having a length [L] of more than 216 mm, in which a count value [f] is allocated to each type. When the length [L] of the recording material P is larger, the allocated count value [f] is larger.

A size detector (not shown) is provided in the image forming apparatus 1 as a means to acquire size information of the recording material P and the length [L] of the recording material P should be the value measured by the size detector. The size detector is, for example, a position detection sensor installed in each supply tray 51.

The surface smoothness [R] is a numerical value which indicates the surface nature of the recording material P and is included in the physical property information of the recording material P. A count value [f] is allocated to each class of surface smoothness [R] as detected by the surface sensor 60*a*, in which different degrees of smoothness are classified. One example given here assumes three classes of surface smoothness [R] in which a count value [f] is allocated to each class. When the surface smoothness [R] is larger, the allocated count value is larger.

The basis weight [T] is included in the physical property information of the recording material P and a count value [f] is allocated to each class of basis weight [T], in which different basis weights are classified. One example given here assumes three classes of basis weight [T]: basis weight [T] of 135 g/m$^2$ or less, basis weight [T] of more than 135 g/m$^2$ and 300 g/m$^2$ or less, and basis weight [T] of more than 300 g/m$^2$, in which a count value [f] is allocated to each class. When the basis weight [T] is larger, the allocated count value [f] is larger.

The basis weight [T] may be replaced by the thickness of the recording material P (material thickness) or the stiffness of the recording material P. As for the count values [f] allocated to the physical property information of the recording material P, whichever physical property is, when the physical property value is larger, the allocated count value [f] is larger.

The physical property information of the recording material P including surface smoothness [R], basis weight [T], thickness (material thickness), and stiffness is, for example, data derived from the type of recording material P and may be data derived from the information relating to the type of recording material P entered by the user through the operation section 80. In this case, the image forming apparatus 1 should have a database as a means to acquire physical property information, in which the database is linked to the information relating to the type of recording material P, for example, the brand of the recording material P, and the physical property information of the recording material P including surface smoothness [R], basis weight [T], thickness (material thickness), and stiffness.

As explained above, the count values [f] linked to the length [L], surface smoothness [R], and basis weight [T] of the recording material P are previously stored in the count value memory 102 by input from the operation section 80 or an external terminal.

[Count Value Integrator 103]

Again referring to FIG. 5, the count value integrator 103 integrates the number of sheets of recording material P passed through the fixing device 40 into the count value [f]. The integrated value is retained as a count integrated value [F].

[Drive Controller 104]

The drive controller 104 controls the drive of the surface homogenizing member 45. The drive controller 104 causes the surface homogenizing member 45 of the fixing device 40 as described above to come into contact with or leave the heating roller 41 of the fixing device 40 according to an instruction from the input/output controller 101.

—Method for Controlling the Image Forming Apparatus 1—

Figure 7:
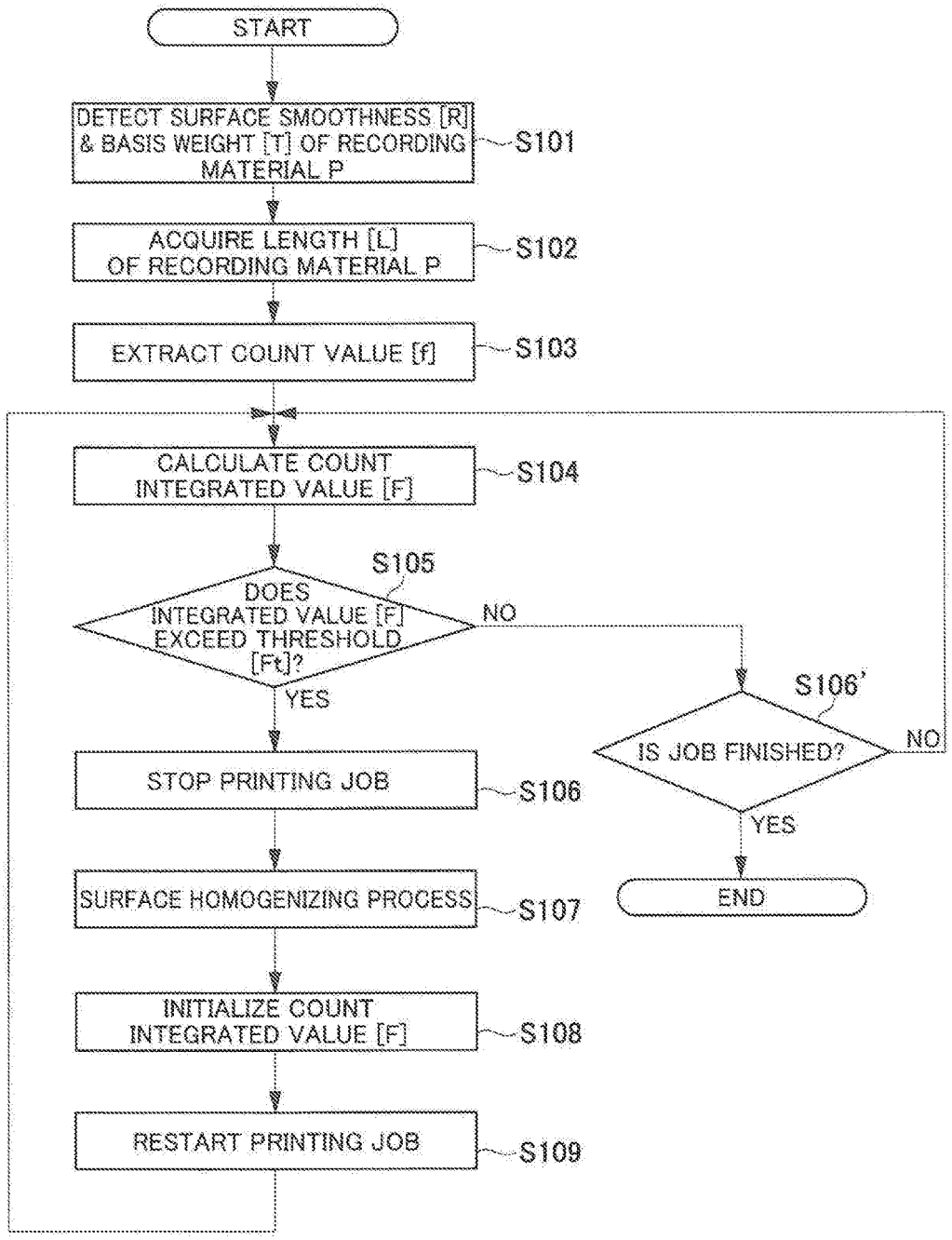
FIG. 7 is a flowchart which shows the method for controlling the image forming apparatus according to the first embodiment.

FIG. 7 is a flowchart which shows the method for controlling the image forming apparatus 1 according to the first embodiment. The control method shown in the figure is the sequence which is performed by the refresh operation controller 100*b* of the controller 100 described in reference to FIG. 5. The sequence is performed when the CPU of the refresh operation controller 100*b* executes the program stored in the ROM or RAM. Next, the method for controlling the image forming apparatus 1 according to the first embodiment will be explained according to the flowchart of FIG. 7 in reference to FIGS. 1 to 6.

<Step S101>

At step S101, upon receipt of information for start of a new printing job from the image formation controller 100*a*, the input/output controller 101 activates the surface sensor 60*a* and basis weight sensor 60*b*. Consequently, the surface smoothness [R] and basis weight [T] of the recording material P supplied to the fixing device 40 are detected.

<Step S102>

At step S102, for performing the printing job, the input/output controller 101 acquires the length [L] of the recording material P passing through the fixing device 40 from the image formation controller 100*a*. In this example, the length [L] of the recording material P is a value derived from the information relating to the type of recording material P which the user has entered through the operation section 80; however, if the image forming apparatus 1 has a size detector for the recording material P, it may be the value detected by the size detector.

<Step S103>

At step S103, the input/output controller 101 extracts the appropriate count value [f] of the recording material P from the count value memory 102 according to the surface smoothness [R] of the recording material P as detected by the surface sensor 60*a*, the basis weight [T] of the recording material P as detected by the basis weight sensor 60*b*, and the length [L] of the recording material P acquired from the image formation controller 100*a*.

<Step S104>

At step S104, the input/output controller 101 causes the count value integrator 103 to calculate a count integrated value [F]. At this time, the count value integrator 103 counts up by adding the count value [f] extracted at step S103 to the current count integrated value [F], to calculate a new count integrated value [F].

<Step S105>

At step S105, the input/output controller 101 decides whether or not the count integrated value [F] calculated by the count value integrator 103 exceeds a preset threshold [Ft]. If it decides that the value exceeds the threshold (YES), the sequence goes to the next step S106. On the other hand, if it decides that the value does not exceed the threshold (NO), the sequence goes to step S106'.

The threshold [Ft] is a value set by the user as the value of an allowable defect appearing in an image on the recording material P due to edge damage of the heating roller 41 of the fixing device 40; for example, the threshold [Ft]= 10000 or so. Here, edge damage refers to damage to the heating roller 41 which is caused by an end edge of the recording material P along the conveyance direction as the recording material P of the same width passes. The threshold [Ft] is previously stored in the RAM of the controller 100 by input from the operation section 80 or an external device.

<Step S106>

At step S106, the input/output controller 101 instructs the image formation controller 100*a* to stop the printing job so that the printing job is stopped.

<Step S107>

At step S107, the input/output controller 101 causes the drive controller 104 to activate the surface homogenizing member 45 of the fixing device 40 to perform processing to homogenize the surface of the heating roller 41. At this time, the drive controller 104 causes the surface homogenizing member 45, which is off the heating roller 41 of the fixing device 40, to come into contact with the heating roller 41 of the fixing device 40. Consequently, the surface homogenizing member 45 polishes the side circumferential surface of the heating roller 41 and removes the edge damage on the side circumferential surface of the heating roller 41 as caused by the recording material P with the passage of the recording material P, so that the side circumferential surface of the heating roller 41 is homogenized and refreshed.

<Step S108>

At step S108, the input/output controller 101 performs processing to initialize the count integrated value [F] to zero. The initialized count integrated value [F] is retained in the count value integrator 103.

<Step S109>

At step S109, the input/output controller 101 instructs the image formation controller 100*a* to restart the printing job and continue the printing job once stopped. After that, the sequence goes back to step S104 and the subsequent steps are repeated.

<Step S106'>

On the other hand, at step S106', the input/output controller 101 decides whether or not the printing job is finished. At this time, the input/output controller 101 makes a decision according to the information from the image formation controller 100*a*. If it is decided that the printing job is finished (YES), the sequence is ended. If it is decided that the printing job is not finished (NO), the sequence goes back to step S104 and the subsequent steps are repeated.

—Advantageous Effects of the First Embodiment—

According to the first embodiment described so far, occurrence of edge damage is predicted according to the physical property information of the recording material P passing through the fixing device 40 and the surface homogenizing process is performed on the side circumferential surface of the heating roller 41. Consequently, the surface homogenizing process can be performed on the side circumferential surface of the heating roller 41 according to the prediction of occurrence of edge damage, so that deterioration of the formed image due to edge damage can be prevented.

Furthermore, occurrence of edge damage is predicted on the basis of the surface smoothness [R] of the recording material P before passing through the fixing device 40. The surface smoothness [R] of the recording material P has been found to be physical property information deeply involved in occurrence of edge damage. Therefore, as compared with the method based only on the length [L] and basis weight [T] of the recording material P and the method based on unstable measurement results of the surface condition of the heating roller 41 of the fixing device 40, this method can improve the accuracy of prediction of occurrence of edge damage. As a consequence, deterioration of the formed image due to edge damage can be prevented reliably and an ineffective surface homogenizing process can be avoided.

<<Second Embodiment>>

—Structure of the Image Forming Apparatus—

Figure 8:
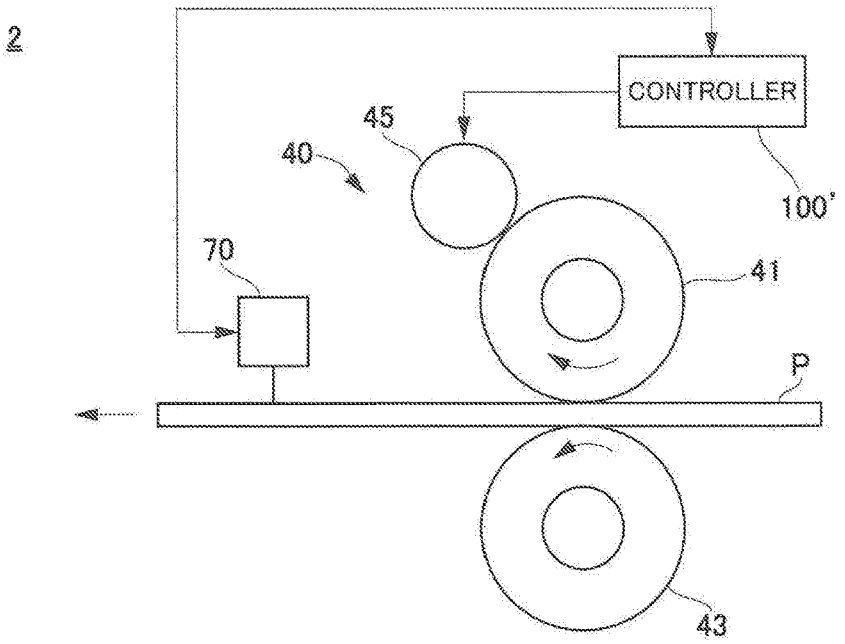
FIG. 8 is a block diagram (1) which shows a key part of the image forming apparatus according to a second embodiment.
Figure 9:
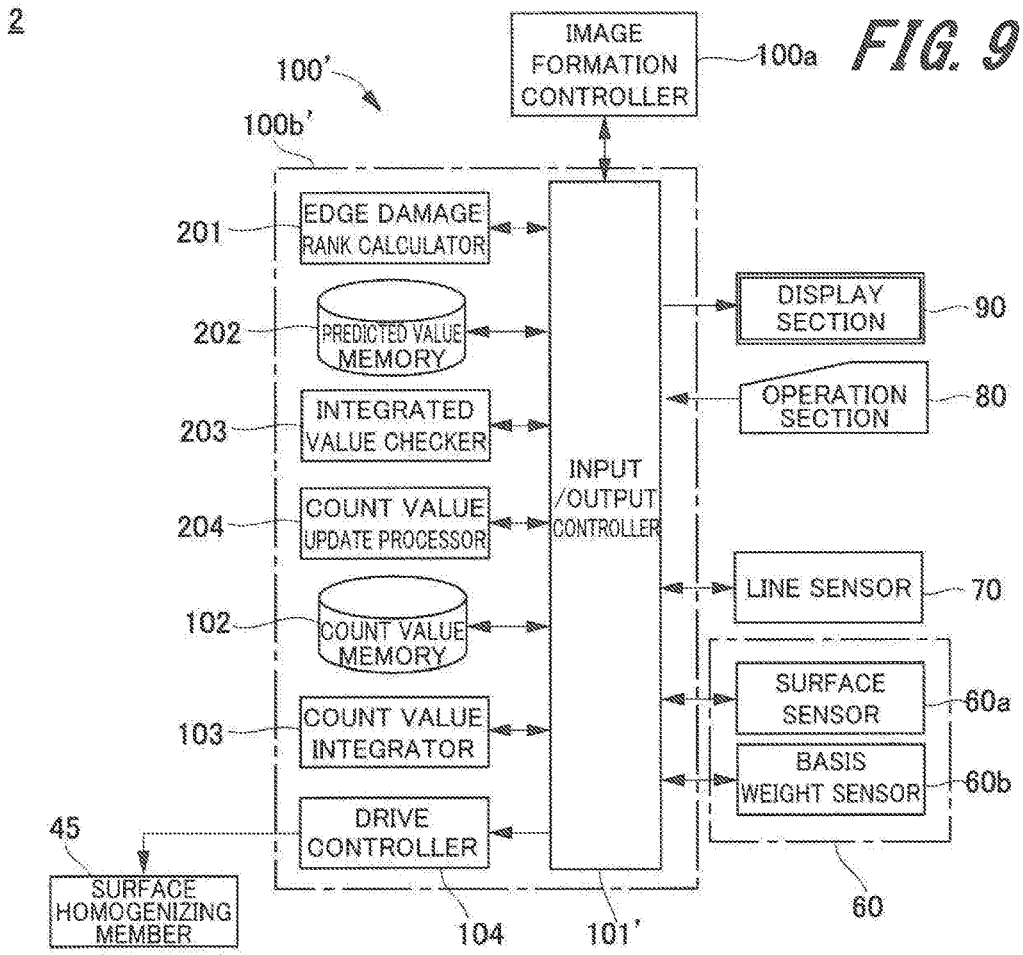
FIG. 9 is a block diagram (2) which shows a key part of the image forming apparatus according to the second embodiment.

FIG. 8 is a block diagram (1) which shows a key part of the image forming apparatus according to the second embodiment. FIG. 9 is a block diagram (2) which shows a key part of the image forming apparatus according to the second embodiment. The image forming apparatus 2 according to the second embodiment shown in these figures is different from the image forming apparatus according to the first embodiment in that the refresh operation controller 100*b*' of the controller 100' for controlling the drive of the surface homogenizing member 45 is connected to the line sensor 70. It is also different in that the refresh operation controller 100*b*' includes an edge damage rank calculator 201, a predicted value memory 202, an integrated value checker 203, and a count value update processor 204. Therefore, only the configuration of the refresh operation controller 100*b*' of the controller 100' is described below and description of the same elements as above is omitted.

<Controller 100'>

The refresh operation controller 100*b*' of the controller 100' controls the drive of the surface homogenizing member 45 of the fixing device 40 according to settings entered from the operation section 80 and an external device such as a personal computer and the result of detection by not only the media sensor 60 but also the line sensor 70.

As shown in FIG. 9, the refresh operation controller 100*b*' includes an input/output controller 101' and the abovementioned count value memory 102, count value integrator 103, and drive controller 104 and further includes the edge damage rank calculator 201, predicted value memory 202, integrated value checker 203, and count value update processor 204. When the CPU of the controller 100' reads and executes the program stored in the ROM, the edge damage rank calculator 201, predicted value memory 202, integrated value checker 203, and count value update processor 204 perform processing as follows.

[Edge Damage Rank Calculator 201]

The edge damage rank calculator 201 calculates the rank of edge damage of the image formed on the recording material P according to the image data acquired from the line sensor 70. Here, edge damage means damage which occurs in the image on the recording material P due to a scar made on the side circumferential surface of the heating roller 41 of the fixing device 40. A scar on the side circumferential surface of the heating roller 41 is a scar which is made by an end edge of the recording material P along the conveyance direction with the passage of the recording material P with the same width.

The ranking of edge damage is based on the image data acquired from the line sensor 70; for example, edge damages are classified into five ranks in order of magnitude. For example, edge damages are ranked as follows: no edge damage as rank 0 and invisible damage as rank 1. Rank 2 refers to a scarcely visible damage which is, for example, a damage which the user considers within the allowable range. Ranks 3 and 4 are apparently visible damages.

[Predicted Value Memory 202]

Figure 10:
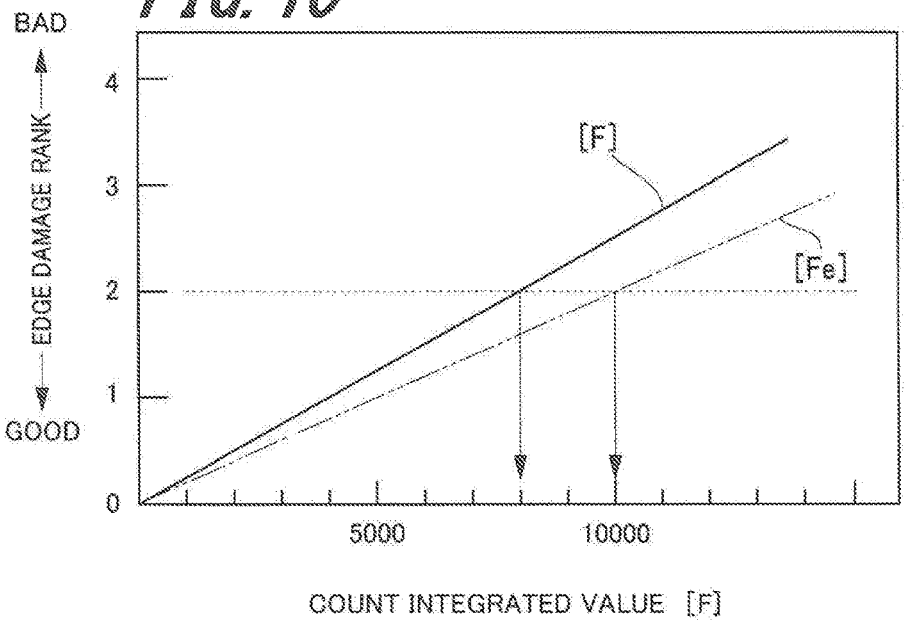
FIG. 10 shows the predicted value of the count integrated value in order to explain the method for controlling the image forming apparatus according to the second embodiment.

The predicted value memory 202 stores the predicted value [Fe] for the count integrated value [F]. FIG. 10 shows the predicted value [Fe] for the count integrated value [F] in order to explain the method for controlling the image forming apparatus according to the second embodiment and is a graph which shows the relation between count integrated value [F] and edge damage rank. The predicted value memory 202 stores the predicted value [Fe] based on prediction of the relation between count integrated value [F] and edge damage rank from the past data.

[Integrated Value Checker 203]

The integrated value checker 203 checks the count integrated value [F] calculated by the count value integrator 103 with the predicted value [Fe] and calculates the difference. Here, for example, the degree of rise in edge damage rank for count integrated value [F], namely the gradient of the graph for count integrated value [F] in FIG. 10 is calculated. Then, the degree of rise for predicted value [Fe] with respect to the degree of rise for count integrated value [F] is calculated as the amount of deviation [d].

[Count Value Update Processor 204]

The count value update processor 204 updates the count value [f] stored in the count value memory 102 according to the amount of deviation [d] calculated by the integrated value checker 203. The count value update processor 204 updates the count value [f] so that the amount of deviation [d] calculated by the integrated value checker 203 coincides with the degree of rise for count integrated value [F].

—Method for Controlling the Image Forming Apparatus 2—

Figure 11:
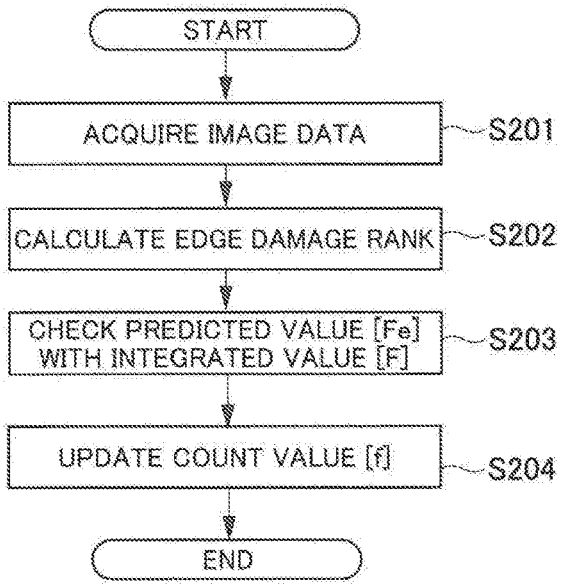
FIG. 11 is a flowchart which shows the method for controlling the image forming apparatus according to the second embodiment.

FIG. 11 is a flowchart which shows the method for controlling the image forming apparatus according to the second embodiment. The method for controlling the image forming apparatus 2 as shown in the figure is a control method for updating the count value [f] as described above for the first embodiment, which is the sequence to be performed by the refresh operation controller 100*b*' of the controller 100' as described in reference to FIG. 9. The sequence is performed when the CPU of the refresh operation controller 100*b*' executes the program stored in the ROM or RAM. Next, the method for controlling the image forming apparatus 2 according to the second embodiment will be described according to the flowchart of FIG. 11, in reference to other figures as necessary.

<Step S201>

At step S201, the input/output controller 101' acquires image data from the line sensor 70. The image data acquired here may be, for example, data of an image formed on a recording material P for inspection which has been used to update the count value [f]. Preferably the recording material P for inspection should be larger in the size in the width direction perpendicular to the conveyance direction than the recording material P on which an image has been formed in the previous printing job.

<Step S202>

At step S202, the input/output controller 101' causes the edge damage rank calculator 201 to calculate the edge damage rank according to the image data acquired at step S201. At this time, the edge damage rank calculator 201 calculates which preset rank the edge damage found in the image data belongs to.

<Step S203>

At step S203, the input/output controller 101' causes the integrated value checker 203 to check the predicted value [Fe] with the count integrated value [F]. At this time, the integrated value checker 203 calculates the degree of rise in edge damage rank for the count integrated value [F], namely the gradient (2/8000) of the graph for the count integrated value [F] as shown in FIG. 10. Then, the degree of rise for the count integrated value [F] with respect to the degree of rise for the predicted value [Fe] is calculated as the amount of deviation [d]. From the graph of FIG. 10, when the degree of rise for predicted value [Fe] is 2/10000, the amount of deviation [d] is calculated as 1.25.

<Step S204>

At step S204, the input/output controller 101' causes the count value update processor 204 to perform processing to update the count value [f]. The count value update processor 204 updates the count value [f] stored in the count value memory 102 according to the amount of deviation [d] calculated at step S203 so that the gradient of the graph for the predicted value [Fe] coincides with the gradient of the graph for the count integrated value [F].

FIG. 12 is a table which explains updating of the count value to be performed in the method for controlling the image forming apparatus according to the second embodiment. As shown in the figure, the count value update processor 204 updates the count value [f] linked, for example, to the surface smoothness [R] and basis weight [T] of the recording material P passed through the fixing device 40 and stored before acquisition of image data at step S201 by multiplication by the amount of deviation [d]=1.25. In the example shown in FIG. 12, the recording material P passed through the fixing device 40 before acquisition of image data at step S201 has a surface smoothness [R] of 1 ([R]=1) and a basis weight of 301 g/m$^2$ ([T]=301) and the count value [f] linked to these physical properties is multiplied by 1.25 for updating.

At step S201, if the recording material P passed through the fixing device 40 before acquisition of image data at step S201 has two or more types of physical properties, the count value [f] should be updated for each type by multiplication by 1.25.

—Advantageous Effects of the Second Embodiment—

According to the second embodiment described above, the count value [f] as the magnitude of damage to the heating roller 41 of the fixing device 40 caused by the recording material P which is expressed in numerical form is updated according to the image data actually acquired by the inline sensor, so the accuracy of prediction of edge damage can be further increased.

The above description of the second embodiment concerns the apparatus and method in which the count value [f] is updated according to the image data acquired by the inline sensor. However, as a variation of the second embodiment, the threshold [Ft] may be updated according to the image data acquired by the inline sensor.

In this case, referring to FIG. 10, for example, if the user sets the count integrated value [F] corresponding to edge damage of rank 2 as threshold [Ft], the threshold [Ft] based on the predicted value [Fe] is 10000 ([Ft]=10000). On the other hand, if the count integrated value [F] corresponding to actual edge damage of rank 2 is calculated as 8000 from the actual edge damage rank acquired according to the image data acquired by the inline sensor and the actual count integrated value [F] ([F]=8000), the calculated value should be taken as a new or updated threshold [Ft].

In each of the above embodiments, it is assumed that the lengths [L] of the recording material P are divided into two classes and count values [f] are allocated for each class. However, instead, it is possible to set a unit length as the length [L] of the recording material P and allocate count values [f] only for the unit length. For example, let's assume length [L]=216 mm as the unit length and allocate count values [f] only for the unit length [L]=216 mm. In this case, even if the recording material P is a long sheet material such as roll paper, the count value integrator should integrate the numerical value obtained by dividing the length of the recording material P passed through the fixing device 40 by the unit length [L]=216 mm, into the count value [f].

Although embodiments of the present invention have been described and illustrated in detail, the disclosed embodiments are made for purposes of illustration and example only and not limitation. The scope of the present invention should be interpreted by terms of the appended claims.

REFERENCE SIGNS LIST

1, 2 . . . image forming apparatus,
41 . . . heating roller (fixing rotary member),
43 . . . pressure roller (fixing rotary member),
45 . . . surface homogenizing member,
53*g* . . . confluent conveyance path,
60 . . . media sensor (physical property information acquisition means),
60*a* . . . surface sensor (physical property information acquisition means),
60*b* . . . basis weight sensor (physical property information acquisition means),
70 . . . line sensor,
100, 100' . . . controller,

102 . . . count value memory,

P . . . recording material

What is claimed is:

1. An image forming apparatus comprising:

a pair of fixing rotary members forming a nip part for nipping a recording material on which a toner image is formed;

a surface homogenizing member for homogenizing a surface a first fixing rotary member among the pair of fixing rotary members;

a hardware processor that acquires physical property information of the recording material; and a controller for controlling drive of the surface homogenizing member according to the physical property information of the recording material acquired by the hardware processor that acquires the physical property information;

wherein the controller integrates a count value obtained by weighting of a magnitude of damage to the fixing rotary member for each value class of the physical property information acquired by the hardware processor that acquires the physical property information, upon each passage of the recording material through the nip part, and if an integrated count value exceeds a prescribed threshold, controls the drive of the surface homogenizing member so as to homogenize the surface of the first fixing rotary member;

wherein the controller includes a count value memory which stores plural count values each linked to a respective one of classes into which values of the physical property information are divided;

wherein the image forming apparatus further comprises a line sensor for reading an image on the recording material that has passed the fixing rotary members; and wherein the controller updates a count value stored in the count value memory or the threshold according to the image read by the line sensor.

2. The image forming apparatus according to claim 1, wherein the physical property information comprises a surface smoothness of the recording medium.

3. The image forming apparatus according to claim 2, wherein the physical property information comprises the surface smoothness of the recording medium and at least one of a basis weight, a thickness, and a stiffness of the recording material.

4. The image forming apparatus according to claim 1, further comprising:

a hardware processor that acquires size information of the recording material, wherein the controller controls the drive of the surface homogenizing member according to the physical property information of the recording material as acquired by the hardware processor that acquires the physical property information and also the size information acquired by the hardware processor that acquires the size information.

5. A method performed by a computer, under control of a program stored in a non-transitory computer-readable storage medium, for controlling an image forming apparatus comprising a pair of fixing rotary members a nip part for nipping a recording material on which a toner image is formed, and a surface homogenizing member for homogenizing a surface of the fixing rotary member, the method comprising:

acquiring physical property information of the recording material by a hardware processor that acquires the physical property information; and controlling drive of the surface homogenizing member according to the physical property information of the recording material as acquired by the hardware processor that acquires the physical property information, to homogenize the surface of the fixing rotary member, wherein the controlling comprises integrating a count value obtained by weighting of a magnitude of damage to the fixing rotary member for each value class of the physical property information acquired by the hardware processor that acquires the physical property information, upon each passage of the recording material through the nip part, and if an integrated count value exceeds a prescribed threshold, controlling the drive of the surface homogenizing member so as to homogenize the surface of the fixing rotary member, wherein the computer includes a count value memory which stores plural count values each linked to a respective one of classes into which values of the physical property information are divided;

wherein the image forming apparatus further comprises a line sensor for reading an image on the recording material that has passed the fixing rotary members; and wherein the computer updates a count value stored in the count value memory or the threshold according to the image read by the line sensor.

* * * * *